United States Patent [19]

Griffin

[11] Patent Number: 4,674,437

[45] Date of Patent: Jun. 23, 1987

[54] SIZE APPLICATOR

[75] Inventor: David J. Griffin, Charlotte, N.C.

[73] Assignee: Ira L. Griffin Sons, Inc., Charlotte, N.C.

[21] Appl. No.: 868,570

[22] Filed: May 30, 1986

[51] Int. Cl.[4] ..... B05C 1/08; B05C 1/12; B05C 3/15; B05C 3/172

[52] U.S. Cl. ..... 118/407; 118/419; 118/405; 118/115; 118/117; 118/424; 118/DIG. 19; 427/359; 427/428; 427/434.4; 28/183; 68/43; 68/46; 68/47

[58] Field of Search ..... 118/407, 414, 419, 405, 118/115, 117, 424, DIG. 19; 68/46, 47, 43; 28/183; 427/359, 428, 434.4

[56] References Cited

U.S. PATENT DOCUMENTS

| | | | |
|---|---|---|---|
| 1,680,497 | 8/1928 | Brown et al. | 427/360 |
| 2,104,052 | 1/1938 | Novak | 118/419 |
| 2,623,377 | 12/1952 | Dungler | 68/43 |
| 2,849,784 | 9/1958 | Adams | 68/43 |
| 2,862,280 | 12/1958 | Suggs | 68/46 |
| 2,884,893 | 5/1959 | Kabelitz | 28/183 |
| 3,067,061 | 12/1962 | Cocker, III | 28/183 |
| 3,284,870 | 11/1966 | Griffin | 28/183 |
| 3,449,156 | 6/1969 | Brown | 118/419 |
| 4,108,110 | 8/1978 | Berry | 118/414 |
| 4,177,304 | 12/1979 | Berry | 427/428 |
| 4,192,712 | 3/1980 | Dreher | 118/405 |
| 4,325,784 | 4/1982 | Dreher | 118/414 |
| 4,340,623 | 7/1982 | Justus | 118/414 |
| 4,413,586 | 11/1983 | Wöhrle | 118/405 |
| 4,565,155 | 1/1986 | Koski | 118/414 |

OTHER PUBLICATIONS

A. Monforts Maschinenfabrik M. Gladbach, "Der universelle Foulard".

*Primary Examiner*—Sam Silverberg
*Assistant Examiner*—Terry J. Owens
*Attorney, Agent, or Firm*—Bell, Seltzer, Park & Gibson

[57] ABSTRACT

The size applicator includes first and second spaced-apart squeeze rolls supported for rotation on a common horizontal axis and having their lower peripheral surface portions at least partially submerged in size solution contained in an open top pan. A single combination immersion and squeeze roll is positioned between the first and second squeeze rolls and on a common horizontal azis with said first and second squeeze rolls. The lower peripheral surface of the combination immersion and squeeze roll is also at least partially submerged in the size solution and pressure engagement is applied between the combination roll and the first and second squeeze rolls to form a pair of yarn squeezing nips therebetween. The sheet of textile yarns is directed into the size applicator and through the nip of the first squeeze roll with the combination roll, beneath the combination roll, and through the nip of the combination roll with the second squeeze roll to provide a pair of successive squeezing actions on the sheet of textile yarns passing through the size applicator.

6 Claims, 5 Drawing Figures

131
82
55
80
25
69
27
33
85
20'
22'
11
21'
41
62
78
76
71
74
67
65
15
90
52
51
20
22
21
5
5
62
77
75
70
66
64
85
20'
22'
10
21'
40
4
4
54
80
24
68
28
32
111
110
104
101
103
102
115
100
116

SIZE APPLICATOR

FIELD OF THE INVENTION

This invention relates generally to a size applicator for uniformly applying size to sheets of textile yarns and the like at a rapid rate of speed.

BACKGROUND OF THE INVENTION

For many years size applicators, commonly referred to as size boxes, have normally included an immersion roll at the entrance end to immediately guide the sheet of yarns downwardly in free flight into the size solution and then upwardly out of the size solution and through one or more pairs of squeeze rolls. The speed of operation of this type of size box has been limited because the yarn is exposed to the size solution for a very short period of time and the parallel yarns tend to become lapped over each other or laced together when they are passed through the size box at high speed.

In an attempt to increase the speeds at which textile yarns could be sized, size boxes with different immersion and squeeze roll arrangements were developed. Examples of size boxes with various types of immersion and squeeze roll arrangements are illustrated in U.S. Pat. Nos. 2,849,784; 2,862,280; 2,884,893; 3,067,061; and 3,284,870. The size boxes of these prior art patents do permit the yarns to be sized at increased speeds because they provide increased exposure of the yarn to the size solution so that the size solution can penetrate into the yarn. This increased penetration of the size requires that increased squeezing pressure be applied by the pressure rolls to remove the desired amount of size from the yarns. However, as nip pressures between the squeeze rolls are increased, the medial portions of the pressure rolls are subjected to deflection or bowing so that the yarns on the outer side portions of the yarn sheets are subjected to greater squeezing pressure than those yarns in the medial portion of the yarn sheet. Also, it is difficult to accurately control and coordinate the rotational speed of the various immersion and squeeze rolls in the size box to maintain the yarns under uniform tension throughout the path of travel through the size box.

SUMMARY OF THE INVENTION

With the foregoing in mind, it is an object of the present invention to provide an improved size applicator which may be operated at extremely high speeds while maintaining the yarns under uniform tension and while applying a uniform amount of size to the yarns extending from one side of the yarn sheet to the other.

The size applicator of the present invention utilizes a very simple arrangement of three rolls with their rotational axes being parallel and on the same horizontal plane, including a single combination immersion and squeeze roll positioned or "sandwiched" between spaced-apart first and second squeeze rolls. Pressure engagement is provided between the combination roll and the first and second squeeze rolls to form a pair of yarn squeezing nips therebetween. Size solution is provided in the valley above the nip of the first squeeze roll and the combination roll and the lower peripheral surface of the combination roll is submerged in the size solution. The sheet of yarns is guided into and through the nip of the first squeeze roll with the combination roll, beneath the combination roll, and through the nip of the combination roll with the second squeeze roll. This arrangement provides a first application of size to one side of the yarn sheet in the valley above the nip of the combination roll and the first squeeze roll, and a subsequent squeezing action at the nip of the first squeeze roll and the combination immersion and squeeze roll. A second application of size is then applied to the opposite side of the sheet of yarns as they pass beneath the combination roll, and a subsequent squeezing action takes place as the yarns pass through the nip of the combination roll with the second squeeze roll. Since the combination roll is "sandwiched" between and in horizontal alignment with the first and second squeeze rolls, even pressures are applied to opposite sides of the combination roll so that the problem of roll deflection normally caused by high pressure nips is greatly reduced or eliminated.

In contrast to the size applicators of the prior art where the level of the size solution is maintained at or above the rotational axis of the rolls, only the lower peripheral surfaces of the horizontally aligned rolls of the present size applicator are in engagement with the size solution to thereby greatly reduce the problem of size slinging normally created by the high speed rotation of the rolls in the size solution. The spaced-apart first and second squeeze rolls are drivingly interconnected and provide driving contact with the combination roll so that uniform peripheral speed is imparted to all of the rolls in the size applicator to maintain uniform tension on the sheet of yarns passing through the size applicator.

BRIEF DESCRIPTION OF THE DRAWINGS

Other objects and advantages will appear as the description proceeds when taken in connection with the accompanying drawings, in which.

DESCRIPTION OF THE ILLUSTRATED EMBODIMENT

Figure 4:
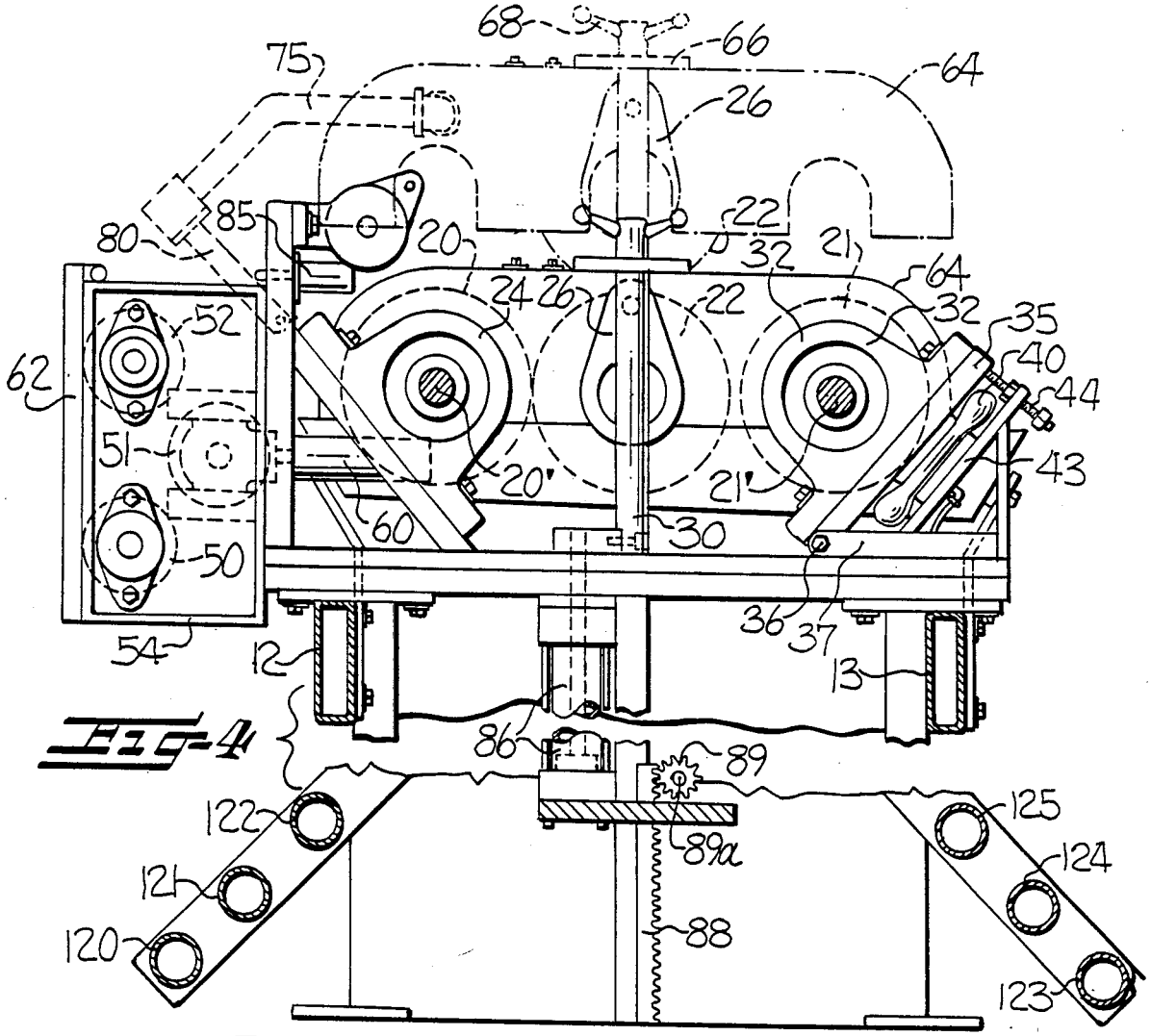
FIG. 4 is a vertical sectional view taken substantially along the line 4—4 in FIG. 3.
Figure 5:
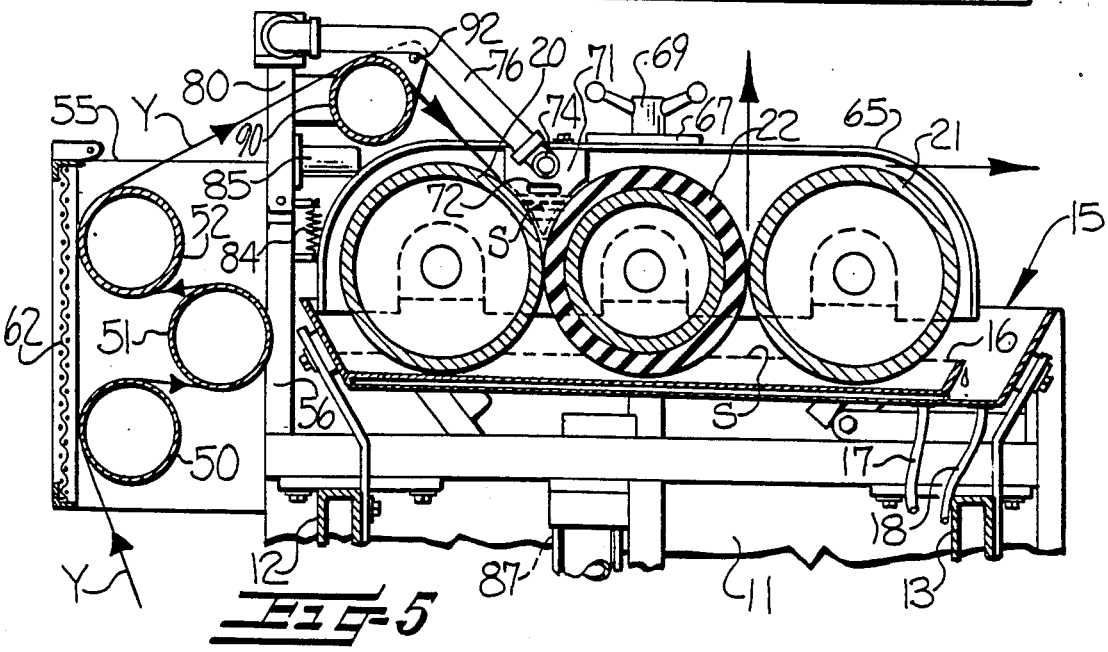
FIG. 5 is a vertical sectional view taken substantially along the line 5—5 in FIG. 3.

As shown in the drawings, the present size applicator includes opposite side frame members 10, 11 which are bridged adjacent the entrance and exit ends by respective transverse channel bars 12, 13 (FIG. 4), suitably connected at opposite ends to the side frames 10, 11. A size tank, broadly indicated at 15 (FIG. 5), is supported at its front and rear edges in spaced position above the channels 12, 13 and includes an open top pan 16 for retaining a quantity of size solution S therein. As shown in FIG. 5, the lower surface of the pan 16 is spaced above the upper surface of the tank 15 to provide a chamber for steam or the like which is introduced through an entry pipe 17 to maintain the size solution S in a heated condition. The pan 16 is adapted to contain a predetermined quantity of size solution S and is tilted slightly in a downward direction toward the exit end so that any excess size solution spills over the exit end plate of the pan 16 and into the tank 15 where it is withdrawn through an exhaust pipe 18.

Spaced apart first and second squeeze rolls 20, 21, preferably stainless steel or chrome-plated, are rotatably supported adjacent opposite ends on the side frames 10, 11 with their lower peripheral surfaces at least partially submerged in the size solution S. A single combination immersion and squeeze roll 22 (FIG. 5) is positioned between the first and second squeeze rolls 20, 21 and has its lower peripheral surface at least partially submerged in the size solution S. The combination immersion and squeeze roll 22 is preferably rubber covered and is of the same diameter as the first and second squeeze rolls 20, 21. In the illustrated size box, each of the rolls 20–22 is ten inches in diameter.

Opposite ends of the first squeeze roll 20 are provided with supporting shaft portions 20' which are in turn rotatably supported in bearing blocks 24, 25. The bearing blocks 24, 25 are fixed in an inclined position (FIG. 4) on the respective frame members 10, 11 for rotatably supporting the first squeeze roll 20 in a fixed position. Reduced shaft portions 22' are provided on opposite ends of the combination immersion and squeeze roll 22 and are rotatably supported in the lower ends of downwardly extending support or swing arms 26, 27, the upper ends of which are pivotally supported for swinging movement on the upper end portions of respective lifting rods 30, 31. Thus, the combination immersion and squeeze roll 22 is supported for limited swinging movement between the first and second squeeze rolls 20, 21, for purposes to be presently described.

Reduced shaft portions 21' are provided on opposite ends of the second squeeze roll 21 and are supported for rotation in bearing blocks 32, 33. As illustrated in FIG. 4, each of the bearing blocks 32, 33 is fixed in an inclined position on a pivot plate 35, the lower end of which is pivotally supported as at 36 on a support plate 37 fixed on the respective side frames 10, 11. Limited arcuate forward and rearward lateral movement is imparted to the second squeeze roll 21 by means of operating air bags 40, 41 which are positioned between the pivot plates 35 and angularly positioned support plates 43 (FIG. 4). Threaded movement limiting rods 44 are connected to the upper end of the pivot plate 35 and extend through the support plate 43. Adjustment nuts are provided on the threaded rods 44 to limit forward and rearward arcuate movement of the squeeze roll 21.

When air pressure is introduced into the air bags 40, 41, they are expanded to move the bearing blocks 32, 33 and the second squeeze roll 21 in an arcuate path toward the entry end of the size box and into pressure engagement with the combination immersion and squeeze roll 22. This pressure engagement forces the combination immersion and squeeze roll 22 into pressure engagement with the first squeeze roll 20 to provide a pair of yarn squeezing nips. When the air pressure is removed from the air bags 40, 41, the pressure engagement between the combination roll 21 and the first and second squeeze rolls 20, 21 is released and the second squeeze roll 21 swings in a clockwise direction to a position as shown in FIG. 4 where it is spaced from the combination immersion and squeeze roll 22. Thus, the air bags 40, 41 and the associated parts provide means for creating pressure engagement between the combination roll 22 and the first and second squeeze rolls 20, 21 to form a pair of yarn squeezing nips therebetween, for purposes to be presently described.

As illustrated in FIG. 5, each of the rolls 20–22 is of the same diameter and the horizontal rotational axis of each of the rolls is aligned along a common horizontal plane when the size box is in operation. However, it is to be understood that the diameter of the rolls 20, 21 may be varied and the rotational axis of the rolls 20, 22 does not have to be horizontally aligned, as long as the lower peripheral surface of the rolls is at least partially submerged in the size solution.

Figure 1:
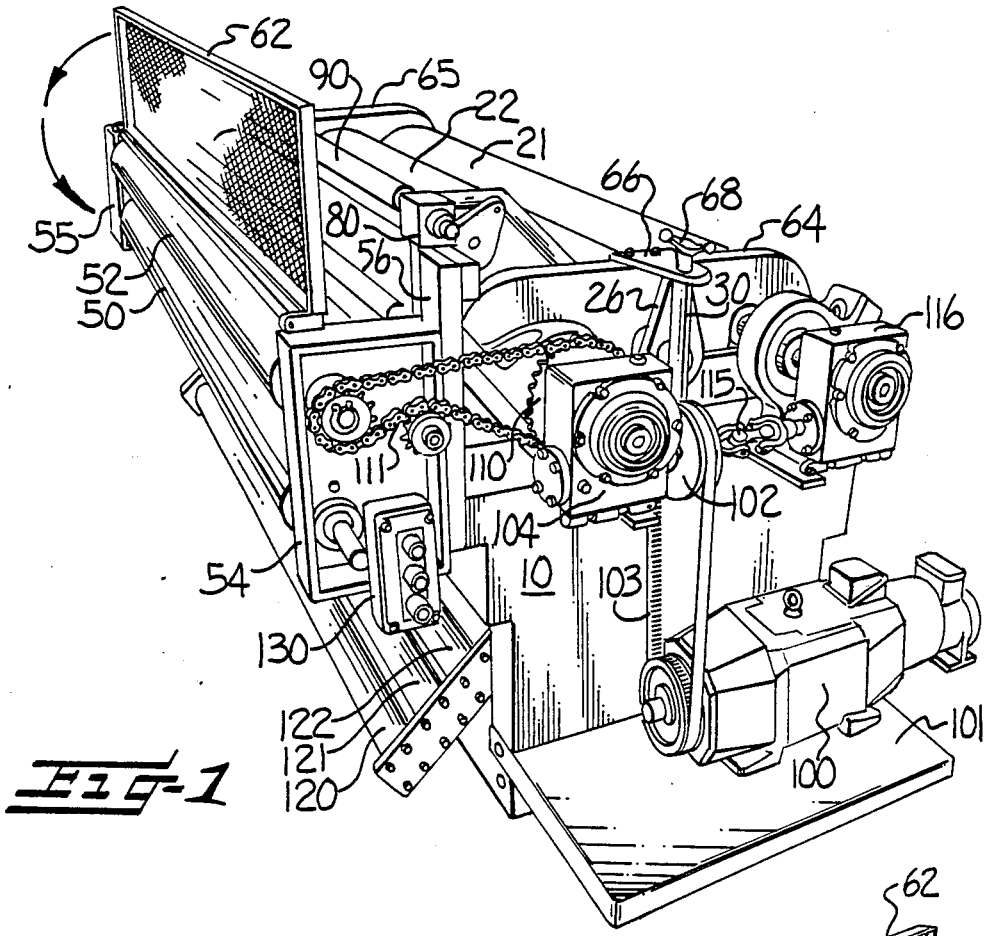
FIG. 1 is a perspective view looking at one end of the size applicator of the present invention.

Means is provided for directing a sheet of parallel and uniformly spaced yarns, indicated at Y in FIG. 5, into the size applicator and through the nip of the first squeeze roll 20 with the combination roll 22, beneath the combination roll 22, and through the nip of the combination roll 22 with the second squeeze roll 21 to provide a pair of successive squeezing actions on the sheet of yarns Y passing through the size applicator. The guide means for the sheet of yarns Y includes a set of rotatably supported draw or feed rolls 50, 51 and 52 (FIG. 5) which are rotatably supported at their opposite ends in bearing blocks on opposite auxiliary frame members 54, 55 supported on upstanding standards 56 fixed on the respective side frames 10, 11. Opposite end portions of the feed roll 51 are supported for horizontal sliding movement in guideways on the inner surfaces of the auxiliary frames 54, 55 and air cylinders 60 are connected thereto to move the feed roll 51 forwardly and rearwardly, as desired. A pivoted guard screen 62 is attached to the auxiliary frame members 54, 55 and may be moved between the lowered operative position shown in FIGS. 4 and 5 and the raised inoperative position shown in FIGS. 1 and 2. The feed rolls 50–52 are driven in timed relationship to the rotational speed of the rolls 20–22, in a manner to be presently described.

Size slinging shields 64, 65 are supported adjacent opposite ends of the rolls 20–22 and have inwardly extending lips extending over the ends of the rolls to prevent slinging of size out of the size box by the size rolls 20–22 as they are rotated at high speeds. The central upper portions of the splash shields 64, 65 are fixed on the inner end portions of horizontal support plates 66, 67, the outer ends of which are fixed on the upper ends of the lifting posts 30, 31 by means of threaded handle members 68, 69. The splash shields 64, 65 are thus raised, as illustrated in dash-dot lines in FIG. 4, when the combination immersion and squeeze roll 22 is raised, in a manner to be presently described, and are lowered to the operative position, as shown in solid lines in FIGS. 4 and 5, when the combination immersion and squeeze roll 22 is lowered to the operative position.

The inwardly extending lips of the splash shields 64, 65 are provided with downwardly extending plate members 70, 71 which are fixed at their upper ends on the inwardly extending lip and the lower ends of which are inwardly curved to fit into the valley between the first squeeze roll 20 and the combination immersion and squeeze roll 22. The lower ends of the plate members 70, 71 extend downwardly to substantially the nip formed between the first squeeze roll 20 and the combination immersion and squeeze roll 22 and to thus close opposite ends of the valley and thereby provide a pool of size solution S in the valley between the adjacent rolls and above the nip thereof, as shown in FIG. 5. Overflow slots 72 are provided in each of the end plates 70, 71 so that the level of size in the valley is maintained at the desired level.

Figure 2:
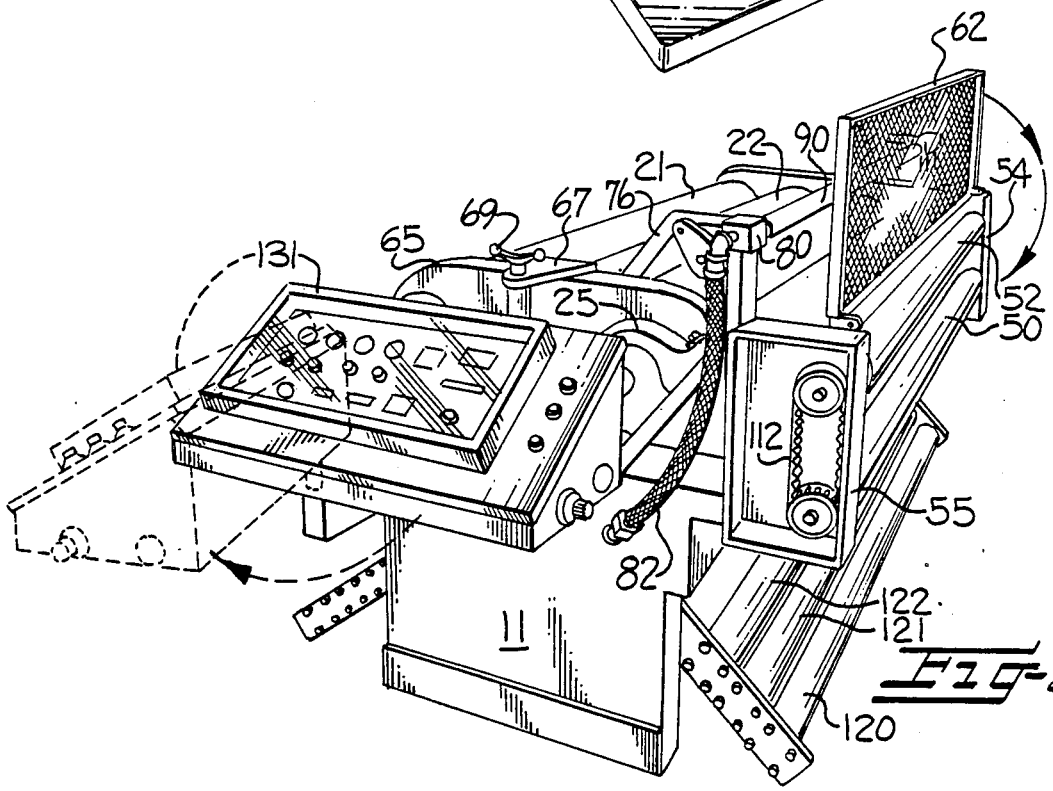
FIG. 2 is a view similar to FIG. 1 but looking at the opposite end of the size applicator.
Figure 3:
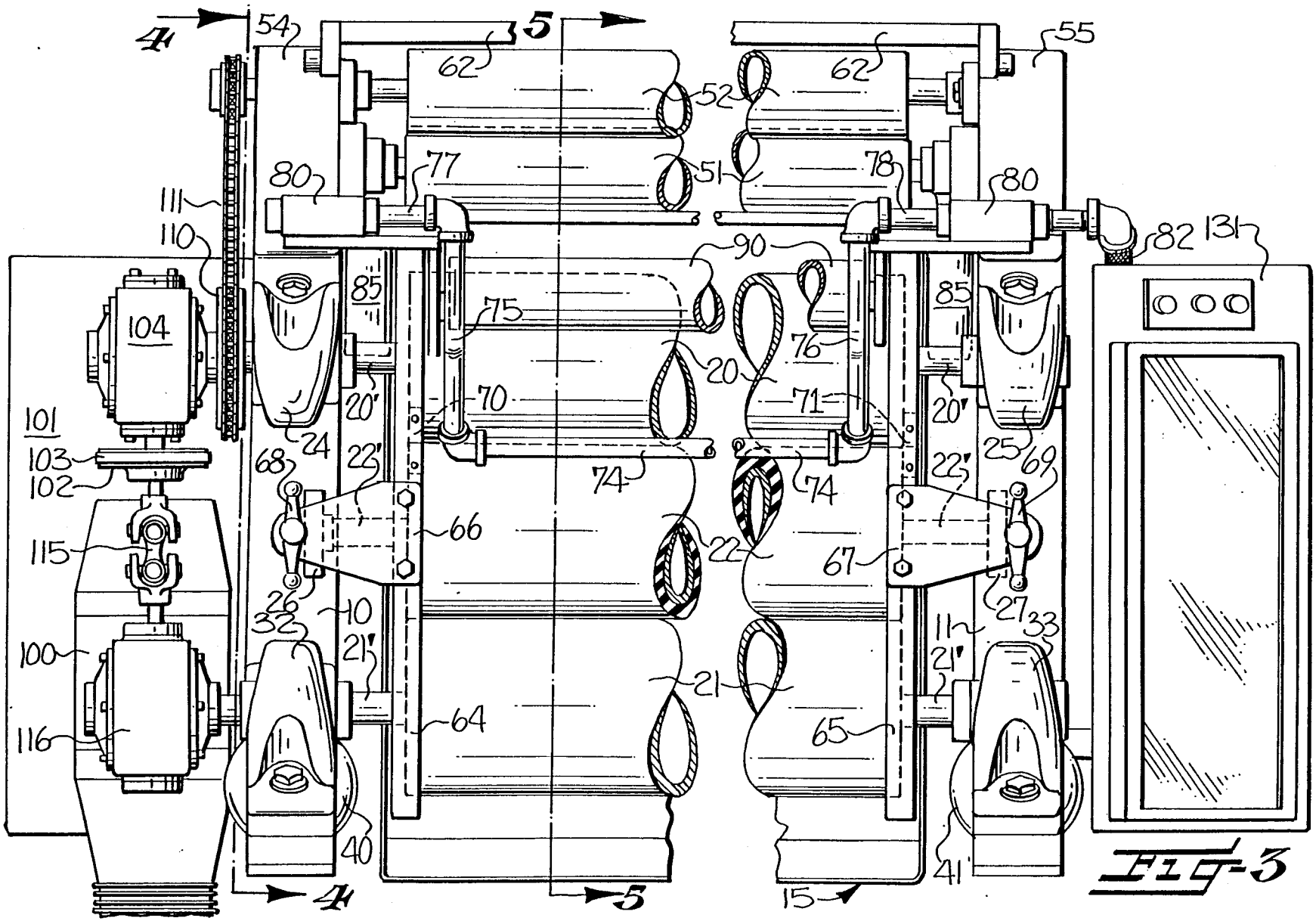
FIG. 3 is a plan view of the size applicator with the central portion broken away.

Size is supplied to the closed valley above the nip of the first squeeze roll 20 and the combination immersion and squeeze roll 22 by means of a horizontally extending supply line 74 provided with outlet openings therein. Opposite ends of the supply line 74 are connected to upwardly and forwardly extending pipes 75, 76 which are in turn connected to horizontal pipes 77, 78 (FIG. 3). The horizontal pipes 77, 78 are fixed in the upper ends of pivoted support arms 80, the lower ends of which are pivotally supported on the upstanding standards 56. A flexible size supply line 82 (FIG. 2) is connected to the supply pipe 78 and to a suitable source of size, not shown, for maintaining a supply of size in the valley above the first squeeze roll 20 and the combination immersion and squeeze roll 22. The horizontal size supply pipe 74 is normally maintained in position above the nip of the combination roll 22 and the first squeeze roll 20, as shown in FIG. 5, by tension springs 84 connected at opposite ends to spring perches fixed on the pivoted arm 80 and on the standards 56. The horizontal supply pipe 74 may be raised in an arcuate counterclockwise movement to the inoperative position shown in dotted lines in FIG. 4 by means of air cylinders 85 which are fixed on the standards 56, when it is desired to move the combination immersion and squeeze roll 22 to the raised inoperative position.

To aid in cleaning and initial threading of the size applicator, the combination immersion and squeeze roll 22 is supported for vertical movement between the lowered operative position shown in FIG. 5 and the raised inoperative position shown in FIG. 4 by means of the lifting posts 30, 31 at opposite ends thereof. The lower end portions of the posts 30, 31 are fixed to the operating piston rod of respective air cylinders 86, 87 (FIGS. 4 and 5) which are fixed on the inner portions of the opposite side frames 10, 11. A rack 88 is provided on the lower ends of each of the lifting posts 30, 31 (FIG. 4) and drivingly engages pinions 89 fixed on opposite ends of a control shaft 89*a* extending between opposite sides of the size applicator. The pinions 89 and racks 88 are coupled together by the shaft 89*a* to insure that both ends of the combination immersion and squeeze roll 22 are lifted and lowered at the same level when being moved between the operative and inoperative positions.

A yarn guide roll 90 (FIG. 5) is rotatably supported at opposite ends in forwardly extending brackets fixed on the standards 56 for directing the sheet of yarns Y from the feed roll 52 and downwardly into engagement with the first squeeze roll 20. The brackets supporting the guide roll 80 have upwardly and forwardly extending portions which support the outer ends of inwardly extending stop pins 92 (FIG. 5) which limit the downward movement of the horizontal supply pipe 74 when in the active position. The stop pins 92 are engaged by the pipes 75, 76 to limit downward movement thereof by the tension springs 84.

The drive means for the feed rolls 50–52 and the squeeze rolls 20, 21 includes a drive motor 100 (FIG. 1) supported on a platform 101 fixed on the side frame 10. The drive motor 100 is drivingly connected to a drive pulley 102 by a timing belt 103. The drive pulley 102 is fixed on the input shaft of a gear box 104, which is supported on the side frame 10 and includes an output drive shaft connected to the shaft of the first squeeze roll 20. A drive sprocket 110 is fixed on the shaft of the squeeze roll 20 and drives a sprocket chain 111 which passes around a drive pulley on the end of the shaft of the feed roll 52 and over a drive sprocket on the end of the feed roll 51. A timing belt 112 (FIG. 2) drivingly connects the feed rolls 50, 52.

The drive pulley 102 is drivingly connected to one side of a universal coupling 115 (FIG. 3) which is in turn connected to the input shaft of a gear box 116. The output shaft of the gear box 116 is drivingly connected to the shaft 21' of the second squeeze roll 21 to drivingly connect the first and second squeeze rolls 20, 21 so that they are rotated at the same peripheral speed.

A first set of yarn guide rolls 120, 121 and 122 is provided at the entrance side and beneath the size applicator and between the side frames 10, 11. A second set of yarn guide rolls 123, 124 and 125 is provided at the exit side of the lower portion of the size applicator and between the side frames 10, 11 for directing a sheet of yarns beneath the size box when the size box is being used in a tandem arrangement. The size applicator is provided with suitable control switches, as indicated at 130 on one side of the size applicator (FIG. 1) and a suitable control panel 131 on the opposite side frame 11. The control panel 131 is supported for swinging pivotal movement, as shown in FIG. 2, between the operative solid line position and the outward position shown in dotted lines to provide access to the bearings for the squeeze rolls 20–22 and for convenience in servicing and repairing the size box.

When the size applicator is threaded with a sheet of textile yarns, as indicated at Y, the yarns extend over the feed roll 50, around the feed roll 51, around the feed roll 52, over the guide roll 90 and then downwardly into engagement with the peripheral surface of the first squeeze roll 20 before they are engaged by any size solution. At this point, the sheet of textile yarns is engaged with the squeeze roll and firmly positioned in uniformly spaced relationship before the size in the valley is applied to one surface of the yarns passing therethrough and downwardly to the squeeze nip between the squeeze roll 20 and the combination immersion and squeeze roll 22. The yarns are maintained in the proper uniformly spaced relationship as they are transferred to the surface of the combination immersion and squeeze roll 22 and are again subjected to size on the opposite side in the size pan 16.

After the second application of size, the yarns are maintained in proper spaced relationship on the combination immersion and size roll 22 and are again squeezed at the nip of the combination immersion and size roll 22 with the second squeeze roll 21. The yarns Y may exit from the size applicator in a straight vertical path after they leave the nip of the combination roll 22 with the second squeeze roll 21, or they may pass partially around the second squeeze roll 21 and leave the size applicator in a horizontal direction, as indicated in FIG. 5. The air bags 40, 41 are supplied with a suitable source of air pressure to provide the proper amount of squeeze on the yarns at the successive first nip between the first squeeze roll 20 and the combination immersion and squeeze roll 22 and the second nip between the combination immersion and squeeze roll 22 and the second squeeze roll 21. Since inward pressure is applied against the second squeeze roll 22, the combination immersion and squeeze roll 22 is sandwiched between the second squeeze roll 21 and the first squeeze roll 20 so that even and uniform squeeze pressures are applied to the yarns at opposite sides of the combination roll 22 and at both yarn squeezing nips. Since the combination immersion and squeeze roll 22 is "sandwiched" between the first squeeze roll 20 and the second squeeze roll 21, even pressures are applied to opposite sides thereof to thereby eliminate any possible roll deflection of the combination roll 22 so that substantially uniform squeezing pressures are applied across the entire width of the sheet of yarns Y. Suitable detectors, not shown, are provided to automatically operate the size supply pump, not shown, to supply size in the valley above the nip of the first squeeze roll 20 with the combination immersion and squeeze roll 22 and any surplus size supplied thereto passes through the overflow slots 72 in the end plates 70, 71 and is deposited in the size pan 16.

In the drawings and specification there has been set forth the best mode presently contemplated for the practice of the present invention, and although specific terms are employed, they are used in a generic and descriptive sense only and not for purposes of limitation, the scope of the invention being defined in the claims.

That which is claimed is:

1. A size applicator for uniformly applying size to a sheet of yarns normally traveling therethrough at high speeds and comprising (a) an open top pan adapted to contain size solution at a predetermined level, (b) first and second spaced-apart squeeze rolls of the same diameter and supported for rotation on parallel axes in a common horizontal plane and having their lower peripheral surface portions at least partially submerged in the size solution, (c) a single combination immersion and squeeze roll positioned between said first and second squeeze rolls, said combination immersion and squeeze roll being of the same diameter as said first and second squeeze rolls and being supported for rotation on an axis which is parallel to the axes of said first and second squeeze rolls and having its lower peripheral surface at least partially submerged in the size solution, (d) means for applying pressure engagement against said second squeeze roll for maintaining pressure engagement between said combination roll and said first and second squeeze rolls to form a pair of yarn squeezing nips therebetween, (e) means for directing the sheet of yarns into the size applicator and through the nip of the first squeeze roll with said combination roll, beneath said combination roll, and through the nip of said combination roll with said second squeeze roll to provide a pair of successive squeezing actions on the sheet of yarns passing through said size applicator, and (f) means associated with said combination immersion and squeeze roll for moving said combination roll between an operative position with its rotational axis on a common horizontal plane with said first and second squeeze rolls, and an inoperative position with its rotational axis positioned substantially above the rotational axis of the common horizontal plane with said first and second squeeze rolls.

2. A size applicator according to claim 1 including drive means drivingly interconnecting said first and second squeeze rolls for drivingly rotating said first and second squeeze rolls at the same peripheral speed.

3. A size applicator according to claim 1 including plate means positioned at opposite ends of said first squeeze roll and said combination roll to provide a size containing closed valley above the nip formed therebetween, and means for supplying size solution into said closed valley above the first yarn squeezing nip to thereby provide a first application of size to the sheet of yarns prior to the yarns passing through said first squeezing nip and while the sheet of yarns is in engagement with the peripheral surface of said first squeeze roll.

4. A size applicator according to claim 3 wherein said plate means is provided with overflow slots so that any surplus size supplied to said closed valley will overflow into said open top size pan.

5. A size applicator according to claim 1 wherein said means for applying pressure engagement comprises bearing means rotatably supporting each of said first and second squeeze rolls and said combination roll, with said bearing means of said first roll being fixedly mounted and said bearing means of said second roll and said combination roll being mounted for limited lateral movement, and means for biasing said bearing means of said second squeeze roll laterally toward said combination roll.

6. A size applicator according to claim 5 wherein said means for biasing said bearing means of said second squeeze roll laterally toward said combination roll includes inflatable air bag means.

* * * * *